United States Patent [19]

Brothers et al.

[11] 3,953,957

[45] May 4, 1976

[54] APPARATUS FOR FORMING CAULKING TUBE CARTRIDGES

[75] Inventors: Don R. Brothers, Canfield; Edwin D. Stewart, Austintown, both of Ohio

[73] Assignee: Century Industries Corporation, New Waterford, Ohio

[22] Filed: May 23, 1975

[21] Appl. No.: 580,248

Related U.S. Application Data

[62] Division of Ser. No. 478,443, June 12, 1974, Pat. No. 3,886,711.

[52] U.S. Cl. ..... 53/329; 53/334

[51] Int. Cl.[2] ..... B65B 7/28; B67B 3/22

[58] Field of Search ..... 53/334, 329, 284, 287, 53/42, 14, 319

[56] References Cited

UNITED STATES PATENTS

| | | | |
|---|---|---|---|
| 2,875,566 | 3/1959 | Sevenpifer | 53/334 |
| 2,884,748 | 5/1959 | Berg | 53/284 X |
| 3,420,927 | 1/1969 | Corrinet | 53/329 X |
| 3,690,088 | 9/1972 | Anderson et al. | 53/329 X |
| 3,713,268 | 1/1973 | Gess | 53/334 |

*Primary Examiner*—Travis S. McGehee
*Assistant Examiner*—Horace M. Culver
*Attorney, Agent, or Firm*—Sidney W. Millard

[57] ABSTRACT

The specification and claims disclose a method and apparatus for performing two manufacturing steps substantially simultaneously during the formation of a caulking tube cartridge. In general, the disclosed method includes the steps of providing a generally cylindrical anvil member adapted to be received in the piston end of the caulking tube; providing a flange ring member including a cylindrical open-ended section having a radially-extending flange; and, providing a protective cap adapted to snap on the nozzle end of the caulking tube. The open-ended section of the flange ring is positioned in the piston end of the tube with the flange overlying the end of the tube. The cap is axially aligned with the tube, and a force is applied to move the tube onto the anvil member. The force is sufficient to snap the cap onto the tube. Thereafter, the tube is rotated and the flange portion is deformed into a bead engaging the end of the tube. The specification also discloses apparatus specifically suited for carrying out the above sequence of steps.

1 Claim, 4 Drawing Figures

APPARATUS FOR FORMING CAULKING TUBE CARTRIDGES

This is a division of application Ser. No. 478,443, filed June 12, 1974, now U.S. Pat. No. 3,886,711, dated June 3, 1975.

BACKGROUND OF THE INVENTION

The subject invention is directed toward the packaging art and, more particularly, to a method and apparatus for applying a protective cap on the nozzle end of a caulking tube while substantially simultaneously therewith rolling a bead on the piston end of the tube.

In commonly assigned patent application Ser. No. 549,811, filed Feb. 14, 1975, and now U.S. Pat. No. 3,930,599 there is disclosed a protective cap adapted to be snapped into position on the nozzle end of a caulking cartridge. The cap is designed to seal the nozzle after the nozzle has been cut and a portion of the caulking compound used. In order to assure that the cap provides a good seal and is not easily dislodged during shipping or handling, it must have a relatively tight, snap-on fit with the tube.

The tight fit required of the cap presents some problems during manufacture. Although the caps are designed to be removed and applied manually, this is not economically practical during high volume manufacturing runs.

The subject inventor has developed a method and apparatus by which a protective cap of the general type described can be readily applied or installed at substantially the same time as another step of the tube manufacturing sequence is carried out. In particular, the tubes which constitute the body of the cartridge are generally formed of paperboard. Normally, during manufacture, a flange ring is placed in the piston end of the tube. The flange portion of the ring is then rolled over the end edge of the tube to form a protective and/or reinforcing bead.

BRIEF DESCRIPTION OF THE INVENTION

The subject invention provides a method and apparatus by which the two above-discussed manufacturing steps can be combined into what is, in effect, a single operation. In accordance with one aspect of the invention, the method generally comprises the steps of:

a. providing a generally cylindrical, rotatable anvil member adapted to be closely received within the piston end of the caulking tube;

b. providing a flange ring member including a cylindrical, open-ended section having a flange extending radially outwardly from one end thereof;

c. providing a protective cap adapted to snap on the nozzle end of the caulking tube;

d. positioning the cylindrical open-ended section of the flange ring member in the piston end of the tube with the flange overlying the end edge of the tube and axially aligning the cap with the tube;

e. axially aligning the piston end of the tube with the anvil and applying sufficient axial force to move the anvil into the piston end of the tube and cause the cap to snap onto the nozzle end; and, f. rotating the tube and the anvil and deforming the flange into a bead about the piston end of the cartridge.

The preferred form of apparatus for carrying out the method constitutes a second aspect of the invention and generally includes a cylindrical anvil member mounted for rotation about its axis. Spaced from the anvil and axially aligned therewith is a cooperating piston member having a recess which faces the anvil member and is adapted to receive the end of the protective cap. Actuating means are provided to drive the piston member toward the anvil under sufficient pressure to cause the anvil to enter the piston end of the cartridge and the cap to be snapped onto the nozzle end of the cartridge. Additionally, power means are provided to rotate the cartridge while it is thus held between the anvil member and the piston member. Also, rolling means are provided to roll the flange into a bead about the piston end of the cartridge during rotation of the cartridge.

As is apparent from the foregoing, the operations of cap applying and bead rolling are effectively combined into a single operation or machine. This has the result of greatly simplifying the overall manufacturing of the cartridges.

Accordingly, a primary object of the invention is the provision of a method and apparatus which combines operations which were previously carried out in separate manufacturing operations.

A more specific object is the provision of an apparatus wherein the movement which positions the cartridge for the bead-rolling operation also applies the protective cap.

BRIEF DESCRIPTION OF THE DRAWINGS

The above and other objects and advantages will become apparent from the following description when read in conjunction with the accompanying drawings wherein.

DETAILED DESCRIPTION OF THE PREFERRED EMBODIMENT

Figure 1:
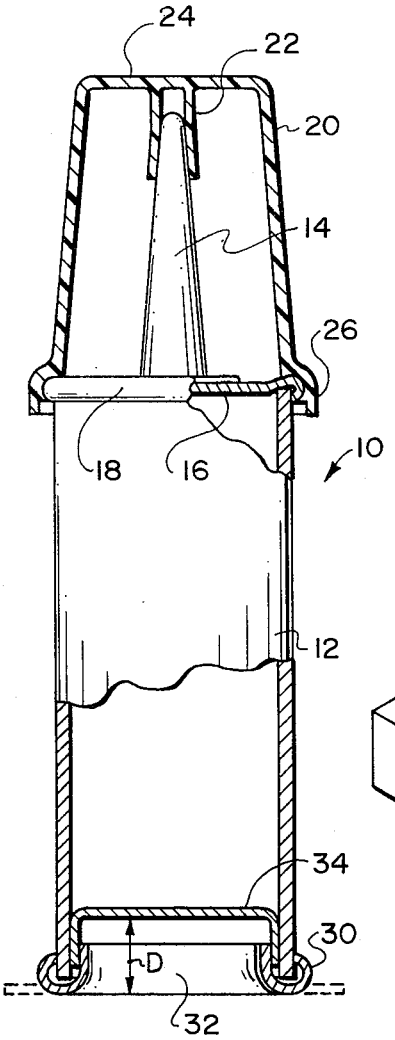
FIG. 1 is a longitudinal cross-sectional view through a caulking tube or cartridge of the type which can be manufactured or assembled through the use of the subject method and apparatus.

Referring more particularly to the drawings wherein the showings are for the purpose of illustrating a preferred embodiment of the invention only, and not for the purpose of limiting same, FIG. 1 shows the overall arrangement of a caulking tube or cartridge of the type which can be readily assembled through the use of the subject method and apparatus. As can be seen, the caulking tube or cartridge assembly 10 comprises a main tubular body 12 generally formed from a relatively heavy paperboard tube. At the upper end of the body 12 is a nozzle member 14 which is typically formed from plastic and carried on a disc-like metal end wall 16 which has its outer periphery 18 flanged over the upper end of the paperboard body 12. In the tube or cartridge assembly 10, a molded plastic cap 20 is releasably snapped to the upper end of the body and arranged to provide a seal for the nozzle 14. This particular cap structure is shown and described more fully in U.S. patent application Ser. No. 549,811, filed Feb. 14, 1975 and now U.S. Pat. No. 3,930,599. The seal means comprise an internal cylindrical portion 22 which extends downwardly from the interior surface of the cap 24. The cylindrical portion 22 is sized so as to tightly engage about the nozzle 14. Consequently, after the nozzle is open, replacement of the cap tightly seals the open end of the nozzle. The cap is tightly but releasably retained on the tube by a snap flange assembly 26 which engages about the bead 18.

During original assembly of the tube-cap combination, the caps must be snapped onto the tube. Although the snapping can be accomplished manually, in large-scale production of the assembly this can constitute a substantial amount of work.

In accordance with the subject invention, the snapping of the cap onto the end of the tube is combined with an additional manufacturing step to reduce the overall problems involved. In particular, about the lower end of the tube body 12 there is a rolled flange 30. Flange 30 is a portion of a flange ring 32 which is slidably received within the piston member 34. As is well known, the piston member 34 is adapted to slide longitudinally in the tube under the influence of an associated caulking gun plunger or the like. Movement of the piston 34, of course, causes the caulking material within the body 12 to be expelled through the nozzle 14. During the manufacture of the tube, the flange member 32 has an original shape shown in FIG. 1 with dash-dot lines. It should be noted that the rolled-over flange portion 30 merely extends outwardly in a radial direction and joins to the cylindrical center portion of the flange ring 32.

Figure 2:
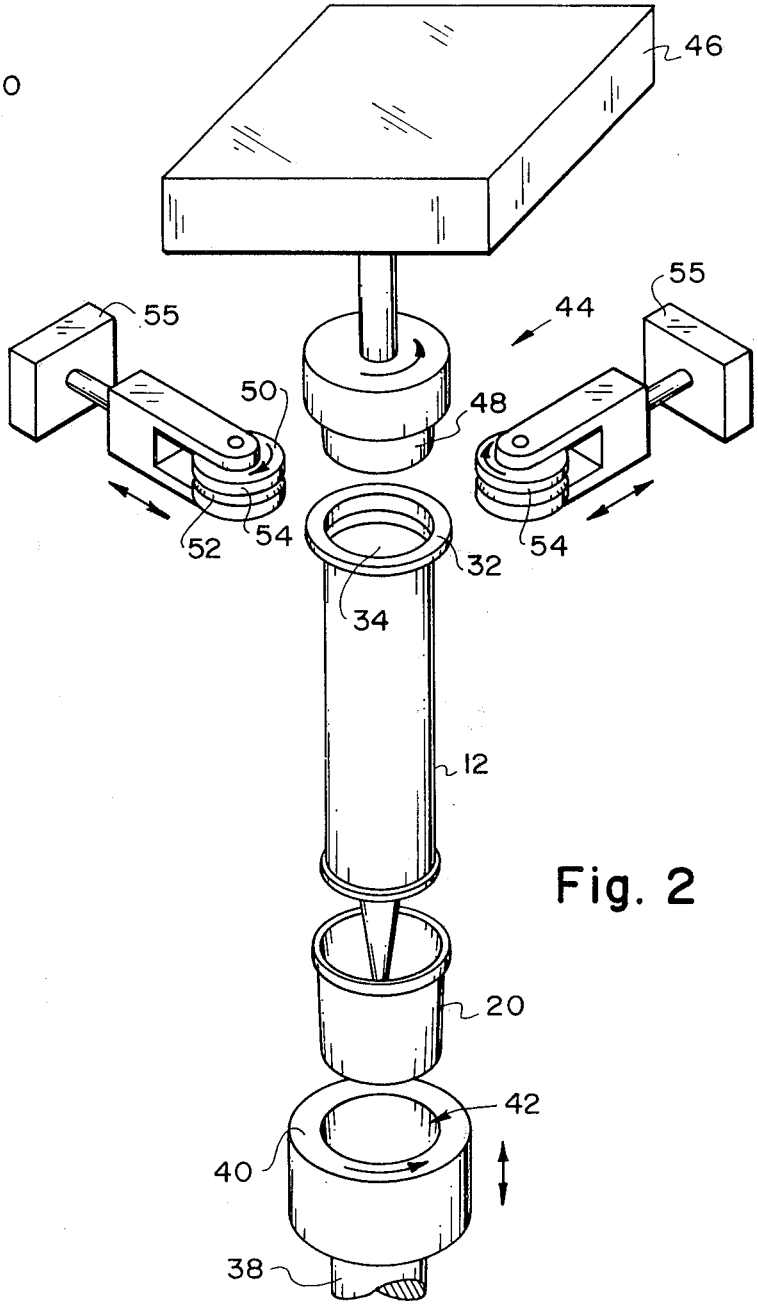
FIG. 2 is a schematic in pictorial form of an apparatus formed in accordance with a preferred embodiment of the invention; and, FIGS. 3 and 4 show the sequence of operations for the apparatus of FIG. 2.
Figure 3:
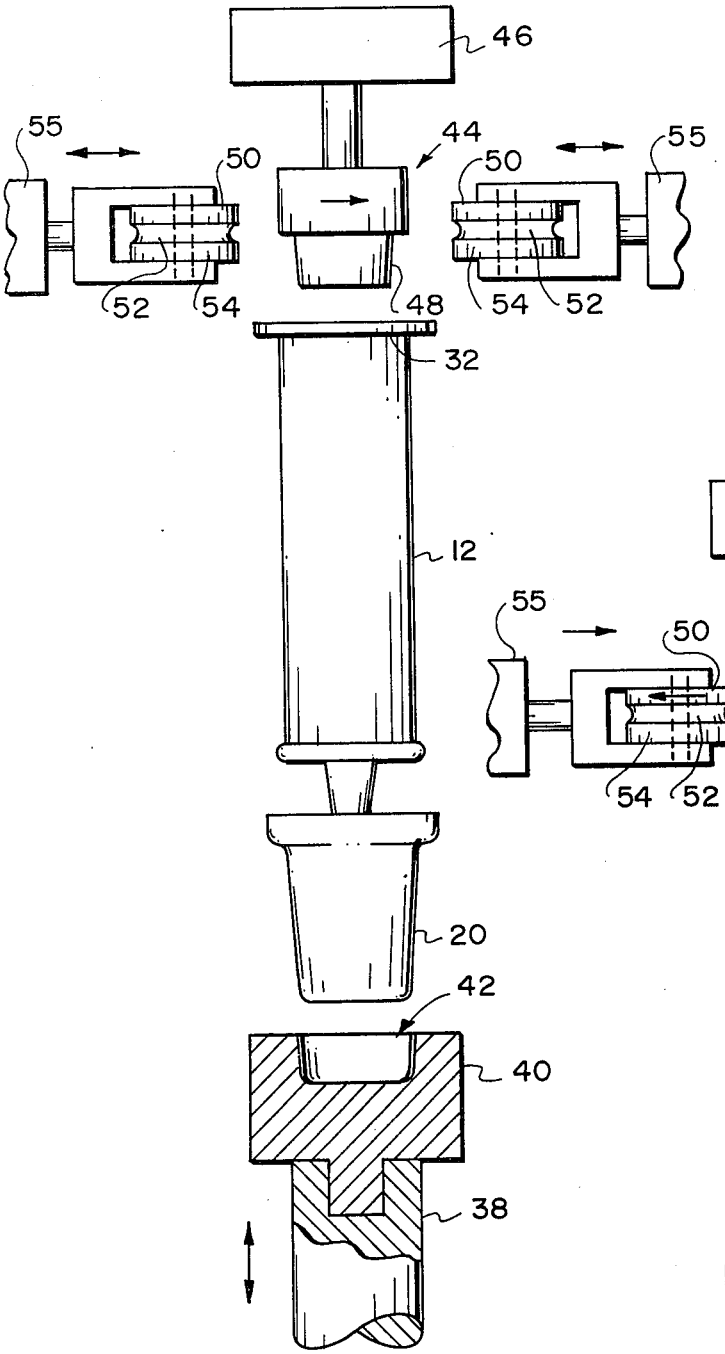
Figure 4:
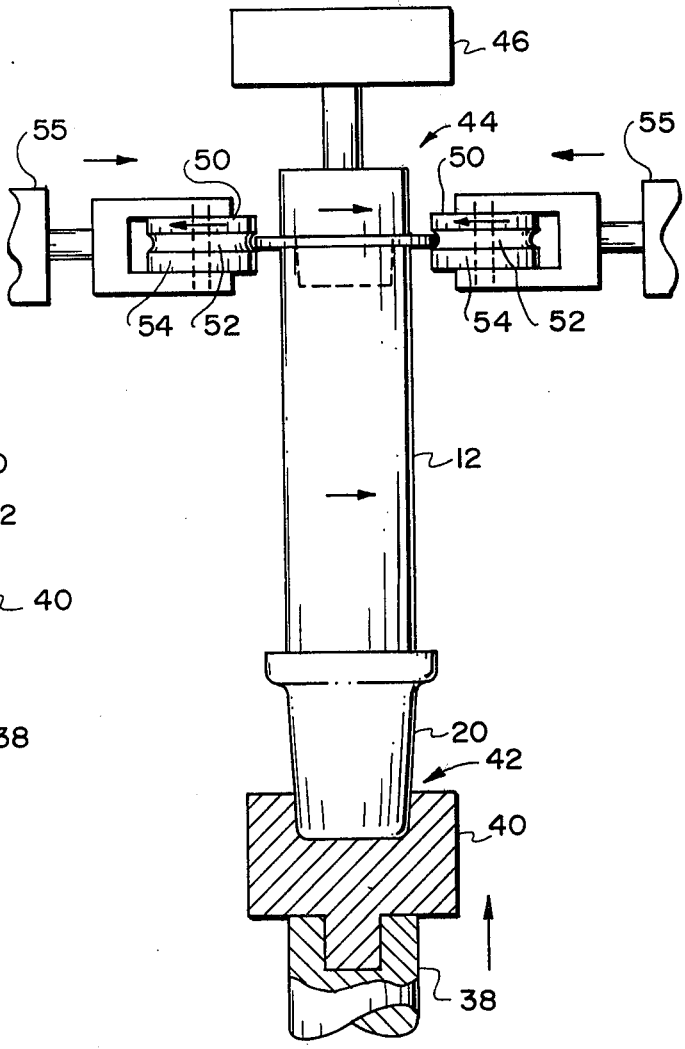

The overall sequence of operations used to assemble the cartridge assembly 10 can best be understood by reference to FIGS. 2–4.

As shown in FIG. 2, the overall apparatus used comprises a first plunger member 38 which is suitably mounted for vertical reciprocation. The particular manner in which the plunger member is driven is not important to the subject invention; however, manual actuation such as through a foot operator or the like could be used if desired. The upper end of the plunger 38 includes a cup-shaped member 40 which is preferably mounted for free rotation relative to the plunger 38. The cup-shaped member 40 has a central opening 42 which is sized so as to freely but closely receive the outer end of the protective cap 20.

Axially spaced from the plunger 38 and axially aligned therewith is an anvil member 44. The anvil member 44 is rotatably mounted and includes drive means 46 adapted to impart driving movement to rotate the anvil in the manner shown. The lower end of anvil member 44 has a reduced diameter portion 48 which is sized so as to be closely received within the flange ring 32. The length of the end portion 48 is preferably slightly less than the depth D from the base of the flange ring to the wall of the plunger 34. As can be seen, the juncture between the reduced diameter end portion 48 and the main body of the anvil provides a shoulder which can bear against the end face or flange portion of the flange ring 32.

Associated with the anvil 44 are one or more crimping rollers 50 which are carried by suitable actuating means 55. The actuating means 55 are positioned to drive the crimping rollers toward the anvil roller. The outer periphery 54 of the crimping rollers 50 include a bead-forming groove 52. The grooves 52 are arranged so as to deform the radially-extending portion of the flange ring into the bead 30.

FIGS. 3 and 4 best illustrate the use of the apparatus of FIG. 2. In particular, as shown in FIG. 3, the operation begins with the plunger spaced apart from the anvil 44 in the manner shown. To begin, a cap and cartridge body 10 are loosely assembled in the relationship shown and the cap received in the opening 42 of the upper end of the plunger. At this time, the crimping rolls 50 are in a retracted position as shown. With the cap and cartridge body loosely assembled and positioned on the upper end of the plunger, the plunger is actuated upwardly to the position shown in FIG. 4. The upward actuation by the plunger causes the tube to be moved onto the anvil 44. That is, the reduced diameter end portion 48 of the anvil 44 enters within the flange ring 32. At this time or subsequent thereto, the driven anvil 44 rotates the tube relative to the plunger 38. With the tube assembly 10 rotating, the crimping rollers 50 are driven inwardly to the position shown in FIG. 4. During inward movement of the crimping rollers 50, the radially-extending flange of the flange ring 32 is caused to deflect over into a bead 30 which tightly grips the paperboard tube 12. As can be appreciated, the movement which brings the tube assembly into proper position on the anvil also causes the cap to be snapped tightly into its position on the nozzle end of the tube.

After bead 30 has been formed, the crimping rolls are retracted. Subsequent thereto, the plunger is reciprocated to a lower position and the assembled cartridge assembly 10 removed from the upper end of the plunger.

The invention has been described in great detail sufficient to enable one of ordinary skill in the packaging art to make and use the same. Obviously, modifications and alterations of the preferred embodiment will occur to others upon a reading and understanding of the specification and it is my intention to include all such modifications and alterations as part of my invention insofar as they come within the scope of the appended claims.

Having thus described my invention, I claim:

1. Apparatus for simultaneously attaching (1) a two piece relatively movable plunger unit and (2) a protective cap to the opposite ends of a caulking tube cartridge, said cartridge being cylindrical and formed from a material selected from the group consisting of paper and metal, said cartridge having one end open and the opposite end closed by a nozzle and means rigidly mounting the nozzle in fluid tight communication with the interior of said cartridge, said plunger unit comprising a flange ring and a plunger, said flange ring including a short cylindrical portion having an axis and a radially extending flange, said plunger being cup shaped with a bottom and cylindrical side wall and mounted coaxially with said flange ring, the cylindrical portion of the ring overlapping and frictionally engaging the cylindrical sidewall of the cup shaped plunger to thereby temporarily hold the two piece plunger unit together, a cylindrical anvil member mounted for rotation about its axis and a piston member spaced from the anvil member and axially aligned therewith, means for producing relative axial movement of the anvil and piston members, means carried by said piston member for receiving said protective cap and pressing it into frictional engagement with both the nozzle and the means for rigidly mounting the nozzle, means carried by said anvil member for forcing the two piece plunger unit into said open end of said cartridge, power means for rotating the cartridge, plunger unit and protective cap as a unit while it is held between the anvil and piston members and rolling means for deforming the radially extending flange of the plunger unit ring into tight locking engagement with the outer surface of the cartridge during rotation of the cartridge, said locking engagement having the property of locking the ring and cylindrical cartridge together against relative movement but allowing the cup shaped plunger to disengage from the ring and move toward the nozzle end of the cartridge upon application of axially directed outside force.

* * * * *